US010222188B2

(12) United States Patent
Kunz et al.

(10) Patent No.: US 10,222,188 B2
(45) Date of Patent: Mar. 5, 2019

(54) PROJECTILE WITH ENHANCED BALLISTIC EFFICIENCY

(71) Applicants: Joshua M. Kunz, Exton, PA (US); Francis J. Sheer, McAdoo, PA (US)

(72) Inventors: Joshua M. Kunz, Exton, PA (US); Francis J. Sheer, McAdoo, PA (US)

( * ) Notice: Subject to any disclaimer, the term of this patent is extended or adjusted under 35 U.S.C. 154(b) by 14 days.

(21) Appl. No.: 14/996,691

(22) Filed: Jan. 15, 2016

(65) Prior Publication Data

US 2016/0327380 A1 Nov. 10, 2016

(51) Int. Cl.

*F42B 14/02* (2006.01)
*F42B 10/44* (2006.01)
*F42B 12/74* (2006.01)

(52) U.S. Cl.

CPC ..... *F42B 14/02* (2013.01); *F42B 10/44* (2013.01); *F42B 12/74* (2013.01); *F42B 12/745* (2013.01)

(58) Field of Classification Search

CPC ..... F42B 10/42; F42B 10/44; F42B 10/46; F42B 12/74; F42B 12/745; F42B 14/02
USPC ..... 102/201
See application file for complete search history.

(56) References Cited

U.S. PATENT DOCUMENTS 2,307,369 A * 1/1943 Ferrel ..... F42B 15/00 102/376
4,327,884 A * 5/1982 Lawhorn ..... F42B 15/105 102/374
4,517,897 A * 5/1985 Kneubuhl ..... B21K 1/025 102/439
5,811,723 A * 9/1998 Stone ..... F42B 12/34 102/509
5,943,749 A * 8/1999 Swank ..... B21K 1/025 102/509
D748,220 S 1/2016 Fricke
9,273,943 B1 * 3/2016 Poulsen ..... F42B 10/00
9,341,455 B2 5/2016 Fricke
9,631,910 B2 4/2017 Fricke
9,829,293 B2 11/2017 Fricke et al.
10,036,619 B2 7/2018 Fricke et al.
2006/0278117 A1 * 12/2006 Emary ..... F42B 30/02 102/519

(Continued)

OTHER PUBLICATIONS

Author Uknown, Copper Alloy Data, Downloaded Feb. 13 2017, Copper Development Association Inc., pp. 1 and 2, found by clicking "Download PDF" button here: https://alloys.copper.org/alloy/C14700?alloy=C14700.*
Page 8 of Nov. 2014 issue of Very High Power Magazine.

*Primary Examiner* — Bret Hayes
(74) *Attorney, Agent, or Firm* — Mintz Levin Cohn Ferris Glovsky and Popeo, P.C.; Jonathon P. Western

(57) ABSTRACT

A projectile for use with a firearm having a rifled barrel including helical grooves extending longitudinally along an inner surface thereof includes: a substantially cylindrical projectile body having at a front end an ogival nose section and at a rear end a tail section, a driving band section formed on the projectile body between the nose section and the tail section having a first diameter, a bore rider section formed on the projectile body between the nose section and the tail section having a second diameter different from the first diameter, and a pilot band section formed on the projectile body forward of the driving band section having a third diameter different from the first diameter and the second diameter.

19 Claims, 6 Drawing Sheets

(56) References Cited

U.S. PATENT DOCUMENTS

| | | | | |
|---|---|---|---|---|
| 2007/0204758 | A1* | 9/2007 | Spatz | F42B 12/34<br>102/514 |
| 2011/0214582 | A1* | 9/2011 | Glasser | F42B 12/44<br>102/439 |
| 2015/0226531 | A1* | 8/2015 | Silvers | F42B 5/28<br>102/439 |
| 2016/0252332 | A1* | 9/2016 | Gelfert | F42B 5/067<br>102/464 |
| 2016/0252334 | A1* | 9/2016 | Cary | F42B 10/46 |
| 2016/0282094 | A1* | 9/2016 | Brown | F42B 14/06 |
| 2018/0209770 | A1 | 7/2018 | Fricke | |
| 2018/0306562 | A1* | 10/2018 | Polovnev | F42B 10/44 |

* cited by examiner

PROJECTILE WITH ENHANCED BALLISTIC EFFICIENCY

BACKGROUND (a) Technical Field

The present disclosure relates generally to projectiles for use in firearms, and more particularly, to projectiles for use in firearms having enhanced ballistic efficiency.

(b) Background Art

Early in the $20^{th}$ century, as the first aircrafts were being built and launched, engineers and mathematicians worked to optimize the flight of such aircrafts, as well as propulsion methods, controls, and the like. One of the shapes that was created through mathematical analysis is known as the Sears-Haack shape. The Sears-Haack shape—derived from the work of William Sears and Wolfgang Haack—is regarded as exhibiting the minimum theoretical wave drag on a given body at high supersonic speeds. A Sears-Haack body is axisymmetric, decreasing smoothly in opposite directions from a maximum diameter at its center to a sharply pointed tip at each end, resembling somewhat the shape of a football. Sears-Haack bodies are reliant upon the Prandtl-Glauert transformation to solve the mathematical singularity that occurs from compression shock (and subsequent wave drag) generated at near-Mach and supersonic speeds.

Any given Sears-Haack body can be mathematically adjusted according to the preference of its designer. Specifically, the dimensions of Sears-Haack shapes, known also as the Haack Series shapes, can be fine-tuned by selecting the parameters in Equations 1 and 2:

$$y = \frac{R}{\sqrt{\pi}}\sqrt{\theta - \frac{\sin(2\theta)}{2} + C\sin^3\theta} \quad \text{[Equation 1]}$$

$$\theta = \arccos\left(1 - \frac{2x}{L}\right), \quad \text{[Equation 2]}$$

where L represents a length of a body, R represents a maximum radius of the body, and C affects the shape of the body.

It can be seen that the Sears-Haack equations allow for a continuous set of shapes determined by the values of L, R, and C. A non-dimensional variable created from L/R is known as the "fineness ratio," or sometimes "aspect ratio," which allows designers to carry a shape of the nose across different bodies (e.g., to investigate scaling effects resulting from changing parameters during design of a body). However, the value of C is the driving force in determining body shape and the defining feature to transform a Sears-Haack shape into any of the specialty Haack shapes.

Two values of C have particular significance for optimizing the aerodynamic design of a body: C=0, signifying minimum drag for a given length and diameter, also known as an "LD-Haack," and C=⅓, signifying minimum drag for a given length and volume, also known as an "LV-Haack." The LD-Haack, in particular, or commonly referred to as the "von Kármán"—named after Theodore von Kármán who developed an adaptation of the Sears-Haack to minimize wave drag on objects travelling at supersonic speeds—has been adopted to optimize the aerodynamic performance of various objects meant to travel through a compressible fluid medium. Not surprisingly, the von Kármán shape is heavily used in current-day aerospace flight vehicles due to its capacity for minimizing drag occurring at the nose cone section of aircrafts. The applicability of von Kármán is not limited to aircrafts, however, as it is possible to implement the von Kármán shape in other types of travelling objects, including firearm projectiles.

SUMMARY OF THE DISCLOSURE

The present disclosure provides a projectile for use with a firearm having a series of LD-Haack (or von Kármán) shaped features for achieving superior ballistic coefficients when compared with projectiles in its weight class, higher velocities when compared with projectiles in its weight class, and higher velocities when compared with projectiles of similar ballistic coefficients. The disclosed projectile can be formed having an LD-Haack shaped nose section as well as a pilot band, driving band lead-on, and/or driving band lead-off having LD-Haack profiles. Further, the disclosed projectile can be formed with a bore rider section to contact an inner surface of the bore of a firearm barrel, a driving band to engage rifling grooves of the barrel, and a pilot band to minimize the parasitic shock created by presenting the surface of the projectile body to compressible air. In this case, the bore rider section has a diameter approximately equivalent to a bore diameter of the barrel, the driving band has a diameter approximately equivalent to a groove diameter of the barrel, and the pilot band has a diameter between the bore diameter and the groove diameter.

According to embodiments of the present disclosure, a projectile for use with a firearm having a rifled barrel including helical grooves extending longitudinally along an inner surface thereof includes: a substantially cylindrical projectile body having at a front end an ogival nose section and at a rear end a tail section, a driving band section formed on the projectile body between the nose section and the tail section having a first diameter, a bore rider section formed on the projectile body between the nose section and the tail section having a second diameter different from the first diameter, and a pilot band section formed on the projectile body forward of the driving band section having a third diameter different from the first diameter and the second diameter.

In this case, the first diameter may be approximately equal to a groove diameter of the barrel, the second diameter may be approximately equal to a bore diameter of the barrel, and the third diameter may be between the groove diameter of the barrel and the bore diameter of the barrel.

The bore rider section may be formed to contact an inner surface of a bore of the barrel, and the driving band section may be formed to engage the grooves of the barrel. Further, the bore rider section may be disposed between the pilot band section and the driving band section.

The projectile may further include helical recessed regions formed in an outer surface of the projectile body and longitudinally extending along a portion of the projectile body. The recessed regions may longitudinally extend along the driving band section.

The projectile may further include a tail transition section formed on the projectile body adjacent to the tail section on a forward side thereof and having an angled surface, with respect to a horizontal axis of the projectile body, that forms a transition from the tail section to a portion of the projectile body adjacent to the tail transition section on a forward side thereof.

In addition, the nose section may be formed having an LD-Haack shape, and a tip of the nose section may be spherically blunted. The tail section may be formed having a boat tail shape. Also, the projectile body may be a monolithically formed body.

The projectile body may be made of at least one solid material selected from a group, such as: copper, a copper alloy, aluminum, tungsten, a polymeric material, and a synthetic material, whereby the copper alloy may be C14-700 with a work hardness of at least half hard.

Furthermore, according to embodiments of the present disclosure, a projectile for use with a firearm having a rifled barrel including helical grooves extending longitudinally along an inner surface thereof includes: a substantially cylindrical projectile body having at a front end an ogival nose section and at a rear end a tail section, a driving band section formed on the projectile body between the nose section and the tail section, a bore rider section formed on the projectile body between the nose section and the tail section, and a pilot band section formed on the projectile body forward of the driving band section, where the pilot band section is formed having an LD-Haack profile.

Furthermore, according to embodiments of the present disclosure, a projectile for use with a firearm having a rifled barrel including helical grooves extending longitudinally along an inner surface thereof includes: a substantially cylindrical projectile body having at a front end an ogival nose section and at a rear end a tail section, a driving band section formed on the projectile body between the nose section and the tail section, a bore rider section formed on the projectile body between the nose section and the tail section, and a driving band lead-on section formed on the projectile body adjacent to the driving band section on a forward side thereof and having an angled surface, with respect to a horizontal axis of the projectile body, that forms a transition from the driving band section to a portion of the projectile body adjacent to the driving band lead-on section on a forward side thereof, where the driving band lead-on section is formed having an LD-Haack profile.

The projectile may further include a pilot band section formed on the projectile body forward of the driving band section, in which case the bore rider section may be adjacent to the driving band lead-on section on the forward side thereof.

The projectile may further include a driving band lead-off section formed on the projectile body adjacent to the driving band section on a rearward side thereof and having an angled surface, with respect to the horizontal axis of the projectile body, that forms a transition from the driving band section to a portion of the projectile body adjacent to the driving band lead-off section on a rearward side thereof, where the driving band lead-off section is formed having an LD-Haack profile. In this case, the bore rider section may be adjacent to the driving band lead-off section on the rearward side thereof, and the ogival nose section may be adjacent to the driving band lead-on section on the forward side thereof.

Furthermore, according to embodiments of the present disclosure, a projectile for use with a firearm having a rifled barrel including helical grooves extending longitudinally along an inner surface thereof includes: a substantially cylindrical projectile body having at a front end an ogival nose section and at a rear end a tail section, a driving band section formed on the projectile body between the nose section and the tail section, a bore rider section formed on the projectile body between the nose section and the tail section, and a driving band lead-off section formed on the projectile body adjacent to the driving band section on a rearward side thereof and having an angled surface, with respect to a horizontal axis of the projectile body, that forms a transition from the driving band section to a portion of the projectile body adjacent to the driving band lead-off section on a rearward side thereof, where the driving band lead-off section is formed having an LD-Haack profile.

BRIEF DESCRIPTION OF THE DRAWINGS

The embodiments herein may be better understood by referring to the following description in conjunction with the accompanying drawings in which like reference numerals indicate identically or functionally similar elements, of which.

Figure 1:
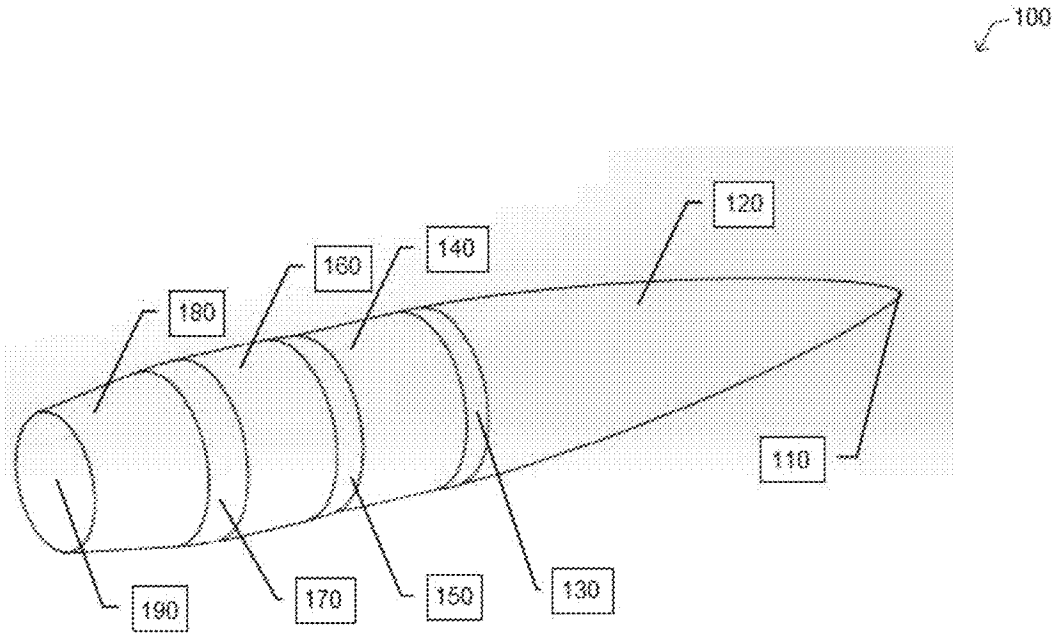
FIG. 1 illustrates a three-dimensional view of an exemplary projectile according to embodiments of the present disclosure.

It should be understood that the above-referenced drawings are not necessarily to scale, presenting a somewhat simplified representation of various preferred features illustrative of the basic principles of the disclosure. The specific design features of the present disclosure, including, for example, specific dimensions, orientations, locations, and shapes, will be determined in part by the particular intended application and use environment.

DETAILED DESCRIPTION OF THE EMBODIMENTS

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. The term "coupled" denotes a physical relationship between two components whereby the components are either directly connected to one another or indirectly connected via one or more intermediary components.

The terms "LD-Haack" or "von Kármán" as used herein refer to a Sears-Haack shape that results in minimum drag for a given length and diameter of a body. The terms "LD-Haack" or "von Kármán" may herein be used interchangeably.

The term "fineness ratio" as used herein refers to a ratio of L/R, where L represents a length of a body, and R represents a radius of the body. The fineness ratio may also be measured in calibers—such measurement is particularly pertinent in bullet design—where the fineness ratio in calibers is equivalent to L/R divided by two. Thus, a projectile nose with a fineness ratio of 6:1 (i.e., L=6 and R=1) would equate to a 3-caliber long nose, for example.

The term "bore diameter" as used herein refers to the internal diameter of a finished cylindrical rifle barrel as it exists prior to the rifling grooves being produced in the bore. The bore diameter also refers to the diameter across the lands or high points in the rifling. In one example, the bore diameter of a 30 caliber barrel is typically 0.300 inches.

The term "groove diameter" as used herein refers to the swept diameter of the rifle barrel grooves at the maximum dimension of the overall bore (after the rifling grooves have been produced in the bore). The groove diameter also refers to the diameter across the grooves or low points in the rifling. Using the above example, the groove diameter of a 30 caliber barrel is typically 0.308 inches, showing a 0.008 inch difference between the bore diameter and the groove diameter.

The term "caliber" as used herein refers to the approximate internal diameter of a firearm barrel or the diameter of the projectile it fires, as is well-known in the art, or can refer to a dimensionless description of a feature on a projectile that is normalized by taking the actual feature size and dividing it by the nominal bore diameter of the rifle barrel. In one example, a feature on a 30 caliber bullet that is 0.450 inches long can be said to be 1.5 calibers long (0.450/0.300=1.5).

The term "ballistic coefficient" or "BC" as used herein refers to a bullet's non-dimensional ratio measuring its ability to overcome air resistance in flight in comparison to a known standard shape. This value is primarily based on sectional density and form factor, and a higher BC indicates greater flight efficiency (e.g., lower negative acceleration, lower drag, etc.).

The term "form factor" as used herein refers to the comparison of drag to a unitized sectional density of a body against a reference shape, where a lower form factor leads to greater flight efficiency.

The term "bearing surface" as used herein refers to the mid-section of a projectile that engages the lands and grooves of a rifle barrel as the projectile transits the barrel when fired.

Referring now to embodiments of the present disclosure, a projectile (i.e., bullet) for use with a firearm is disclosed herein having a series of LD-Haack (or von Kármán) shaped features. The disclosed projectile can be formed having an LD-Haack shaped nose section as well as a pilot band, driving band lead-on, and/or driving band lead-off having LD-Haack profiles. Further, the disclosed projectile can be formed with a bore rider section having a diameter approximately equivalent to a bore diameter of the barrel, a driving band having a diameter approximately equivalent to a groove diameter of the barrel, and a pilot band having a diameter between the bore diameter and the groove diameter. The design of the projectile results in higher efficiencies while moving through the rifle bore, as well as subsequent flight downrange, and greater accuracy and precision upon impact on target, when compared with conventional bullets having a similar weight, a similar BC, or the like.

Figure 2:
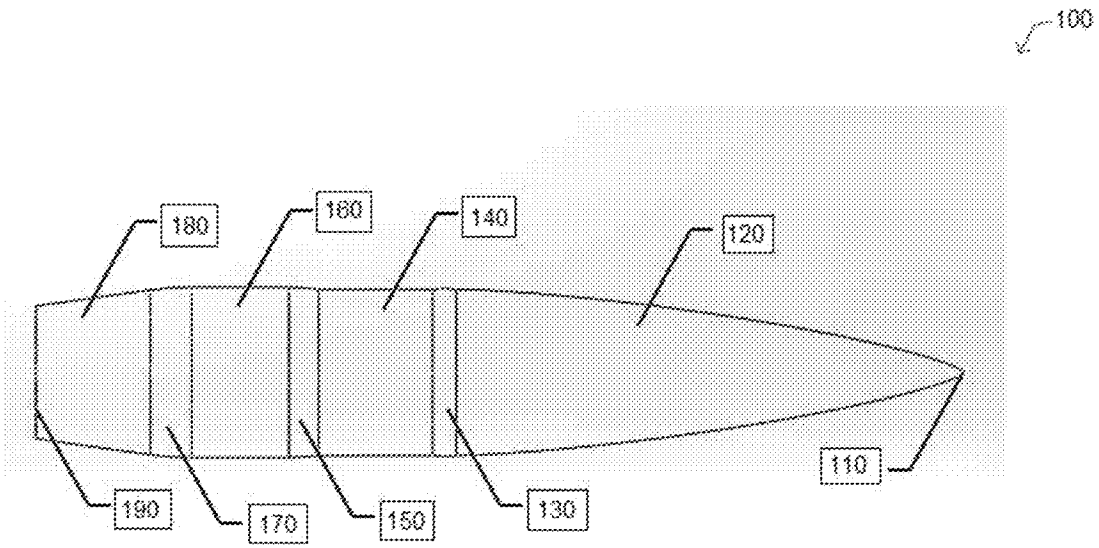
FIG. 2 illustrates a side view of the exemplary projectile shown in FIG. 1.

FIG. 1 illustrates a three-dimensional view of an exemplary projectile according to embodiments of the present disclosure, and FIG. 2 illustrates a side view of the exemplary projectile shown in FIG. 1. As shown in FIGS. 1 and 2, the projectile 100 may include, in order from a front of the projectile 100 to its rear, a meplat 110, an ogival nose section 120, a pilot band section 130, a bore rider section 140, a driving band lead-on section 150, a driving band section 160, a tail transition section 170, a tail section 180, and a base 190. While the projectile 100 is depicted in FIGS. 1 and 2 as including the components listed above, it should be understood that the configuration of the projectile 100 shown in FIGS. 1 and 2 does not limit the scope of the present disclosure and can be modified in any manner as would be deemed suitable by a person of ordinary skill in the art consistent with the scope of the claims set forth herein. For demonstration purposes, various designs and configurations of the projectile 100 are described hereinbelow, though the disclosed projectile is not limited to such designs and configurations but is limited only by the claims set forth herein.

The projectile (i.e., bullet) 100 is intended be propelled or fired using a firearm, provided that the projectile 100 is first installed in a cartridge including a case, a propellant (e.g., gunpowder), a primer, etc., as is understood in the art. The firearm (not shown) may have a rifled barrel including helical grooves extending longitudinally along an inner surface thereof, and the projectile 100 can be formed to engage the rifling of the barrel, as described in further detail below. The projectile 100 is formed as a substantially cylindrical body, whereby the projectile 100 can be manufactured as a single, monolithic body or as a polylithic body (e.g., including a jacket enclosing a solid core, or otherwise). In one example, the projectile 100 is made of at least one solid material, such as copper or a copper alloy. In such case, the projectile can be turned individually from a copper or an alloyed copper bar stock on a lathe. The copper alloy may be, for instance, C14-700 with a work hardness of at least half hard. Alternatively, the copper alloy may be C11-300. In another example, the projectile 100 is made of at least one solid material with physical properties sufficient for use as a firearm projectile, such as aluminum, tungsten, a polymeric material, or synthetic material, or any combination thereof.

Figure 6:
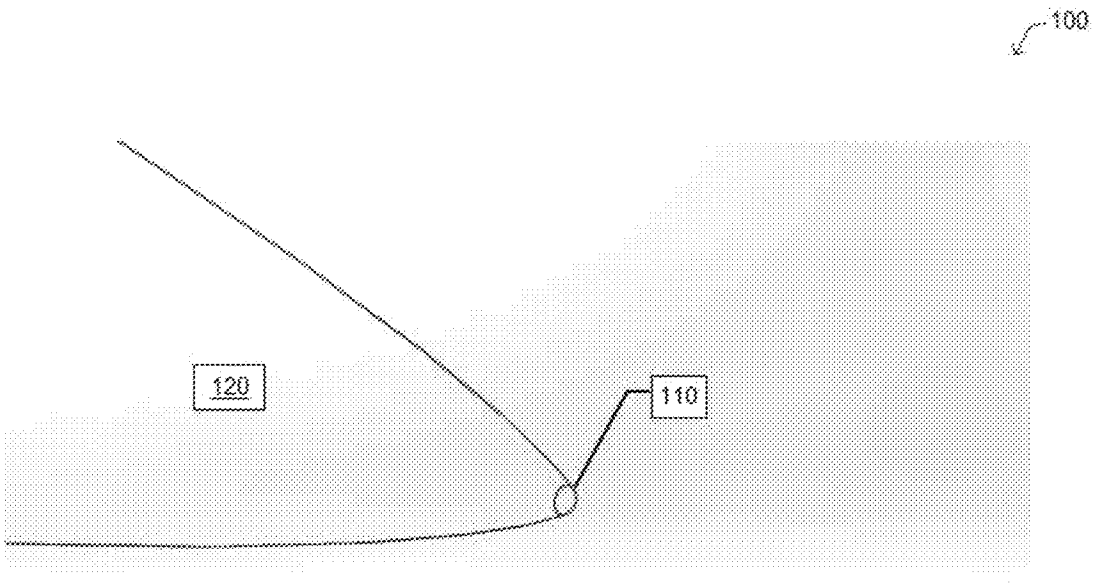
FIG. 6 illustrates a close-up three-dimensional view of a meplat of the exemplary projectile according to embodiments of the present disclosure.

The projectile 100 may include at a front end an ogival nose section 120 and at a rear end a tail section 180. First, the nose section 120 may be shaped as an ogive, that is, a rounded nose cone. A forward tip of the nose section 120, known as the meplat 110, may be truncated or blunted spherically (or hemispherically). In one example, during manufacturing of the projectile 100, the tip of the nose section 120 can be blunted using a 0.01-0.03 caliber diameter sphere. Truncating the meplat 110 in this manner can increase manufacturing repeatability, as well as protect the projectile 100 and end user from damage and injury, respectively, while handling. The meplat 110 is shown in additional detail in FIG. 6 which illustrates a close-up three-dimensional view of the meplat of the exemplary projectile according to embodiments of the present disclosure. The intentional blunting of this projectile is calculated so as to minimize the impact to the overall drag formulation of the projectile.

Additionally, the contour of the ogival nose section 120 may be defined by LD-Haack (or von Kármán) in order to minimize drag at the front end of the projectile 100. That is, the nose section 120 can be formed having an LD-Haack shape. In one example, the fineness ratio of the nose section 120 is set to somewhere between 1.5 and 5.0 calibers. The LD-Haack shaped nose allows for reduced amounts of bow shock at the front of the projectile 100. (Bow shock refers to a compression shockwave created by a forward section of a body moving through air at a velocity high enough to cause the surrounding compressible fluid to compress and cause a mathematical singularity in the flow behavior around the forward portion of the projectile.) This design results in greater aerodynamic performance at the front end of the projectile 100, as the shock generated at the blunted meplat 110 does not create excessively disruptive flow down the ogival nose section 120. Alternatively, the nose section 120 can be manufactured to employ a traditional circular, conic, or other type of ogive.

A pilot band section 130 may be formed on the body of the projectile 100 and disposed forward of the bore rider section 140 and the driving band section 160. As shown in FIGS. 1 and 2, the pilot band section 130 may be disposed immediately rearward of the nose section 120. The pilot band section 130 may be formed having an LD-Haack profile to reduce the parasitic shock or drag created by presenting the surface of the projectile 100 to compressible air. (Parasitic drag refers to friction drag caused by a body moving with relationship to fluid particles around it.)

Additionally, in order to minimize the effect of the already reduced shock, the pilot band section 130 may not be formed to "full height," meaning that its maximum diameter (i.e., "third diameter") would fall between the groove diameter and the bore diameter of the bullet caliber. For instance, in a 30 caliber barrel with a bore diameter of 0.300 inches and a groove diameter of 0.308 inches, the diameter of the pilot band section 130 may be approximately 0.304 inches. Such illustration may be more clearly visible in the side view of the projectile 100 shown in FIG. 2. This allows the pilot band section 130 to behave as a centering band on the projectile's midsection while simultaneously minimizing its aerodynamic effect on the overall wave drag. In some configurations of the projectile 100, the pilot band diameter can be set to the bore diameter plus 35-70% of the difference between the groove diameter and the bore diameter. Also, the fineness ratio of the pilot band section 130 can be set between 6:1 and 16:1, depending on projectile caliber.

Figure 4:
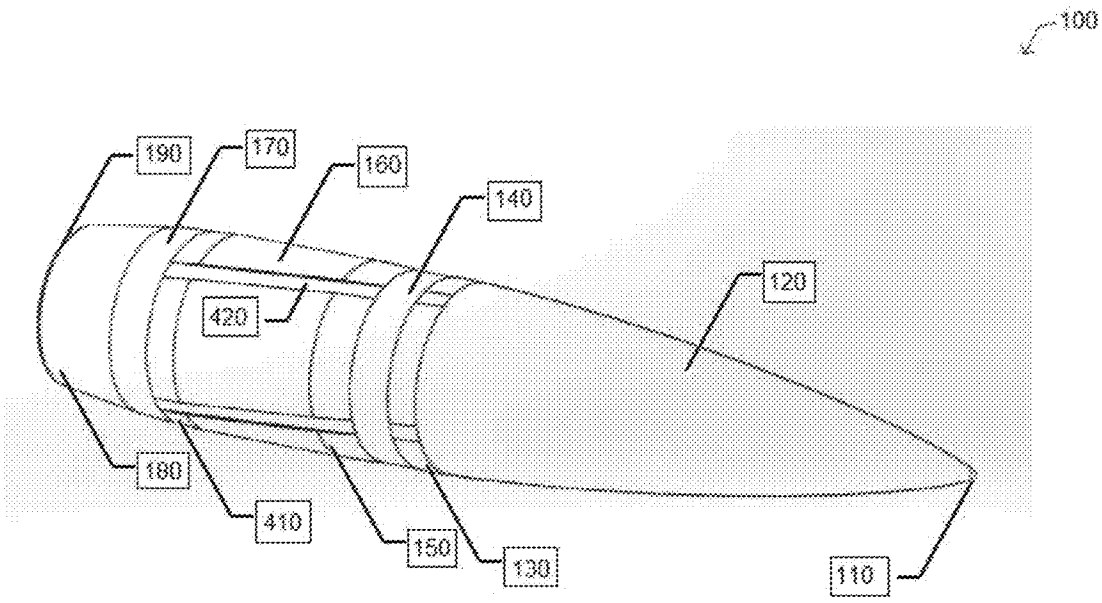
FIG. 4 illustrates a three-dimensional view of an exemplary projectile with rifling grooves according to embodiments of the present disclosure.
Figure 5:
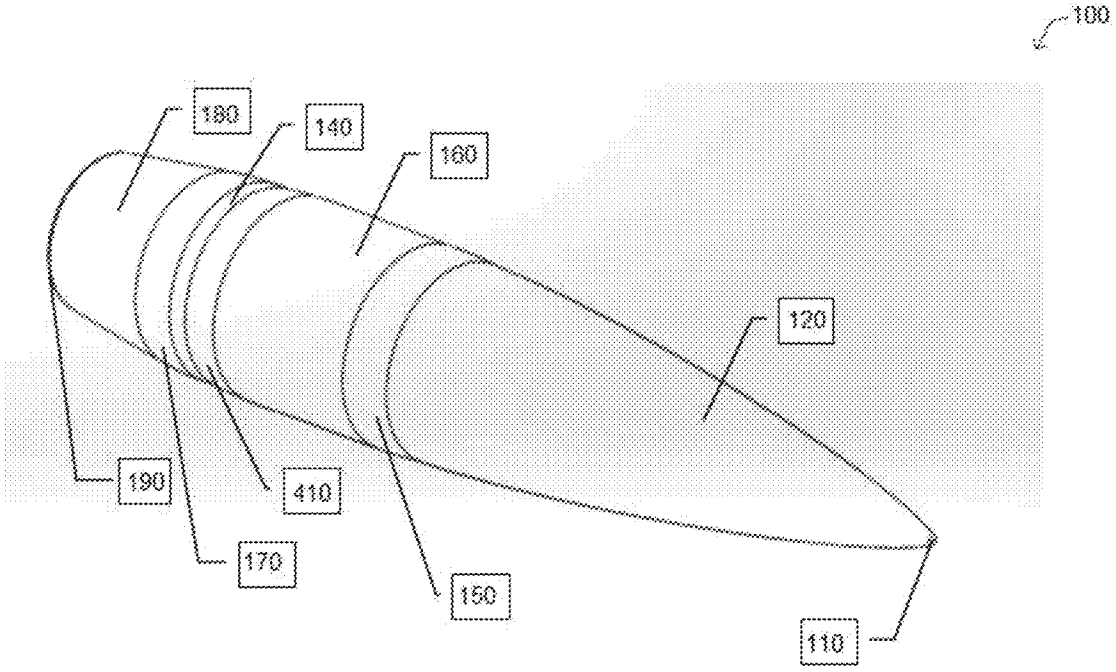
FIG. 5 illustrates a three-dimensional view of an exemplary projectile designed for optimal magazine loading according to embodiments of the present disclosure.

Notably, the projectile 100 may be designed without a pilot band section 130 (e.g., see FIG. 5). Use of the pilot band section 130 is particularly advantageous on projectiles with longer nose and bearing surface, e.g., to minimize the amount of the bullet in the case or to maximize ballistic coefficiency, such as the projectiles depicted in FIGS. 1-4.

A bore rider section 140 may also be formed on the body of the projectile 100 and disposed between the pilot band section 130 and the driving band section 160 (on projectiles which include the pilot band section 130). The bore rider section 140 can be a substantially cylindrical section of the projectile 100. Further, the bore rider section 140 can be formed to contact an inner surface of a bore of a firearm barrel. That is, the diameter of the bore rider section 140 (i.e., "second diameter") is approximately equal to a bore diameter of the barrel. Referring to the example above, in a 30 caliber barrel with a bore diameter of 0.300 inches and a groove diameter of 0.308 inches, the bore rider diameter may be approximately 0.300 inches. In some configurations of the projectile 100, the bore rider diameter can set to the nominal bore diameter +/−0.002 inches, or more particularly, +0.0005 inches or −0.001 inches.

In addition, a driving band section 160 may be formed on the body of the projectile 100 and disposed rearward of the pilot band section 130 and the bore rider section 140 (on projectiles which include the pilot band section 130). Like the bore rider section 140, the driving band section 160 can be a substantially cylindrical section of the projectile 100. The driving band section 160, which is larger in diameter than the pilot band section 130 and the bore rider section 140, may be formed to engage the grooves of a rifled barrel. Thus, the driving band diameter (i.e., "first diameter") can be approximately equal to a groove diameter of the barrel. Referring once again to the example above, in a 30 caliber barrel with a bore diameter of 0.300 inches and a groove diameter of 0.308 inches, the driving band diameter may be approximately 0.308 inches.

In this manner, the driving band section 160 can act to seal the bore from propellant gasses escaping around the body of the projectile 100, as well as act as the load path for the rifling to engrave and drive the projectile 100 rotationally and impart stabilizing spin thereto. Furthermore, the driving band section 160 can engage the neck of the cartridge brass when loaded into ammunition.

Adjacent to the driving band section 160 on a forward side thereof, a driving band lead-on section 150 can be formed on the body of the projectile 100. As shown in FIG. 1 and, in particular, FIG. 2, the driving band lead-on section 150 can have an angled or tapered surface, with respect to a horizontal axis of the projectile 100, that forms a transition from the driving band section 160 to the portion of the projectile body adjacent to the driving band lead-on section 150 on a forward side thereof. In FIGS. 1 and 2, the bore rider section 140 is the portion of the projectile body adjacent to the driving band lead-on section 150 on the forward side thereof. Thus, in this case, the driving band lead-on section 150 forms a transition from the bore rider section 140 to the driving band section 160. The transition may be smooth, i.e., an entirety of the driving band lead-on section 150 extends at a single angle with respect to the horizontal axis of the projectile 100, or multi-angled, i.e., the driving band lead-on section 150 extends at plural angles with respect to the horizontal axis of the projectile 100. Also, the fineness ratio of the driving band lead-on section 150 can be set between 4:1 and 10:1, depending on projectile caliber and the bore to groove diameter relationship.

Like the pilot band section 130, the driving band lead-on section 150 can be formed having an LD-Haack profile to reduce the effect of drag on the projectile 100. Therefore, the effect of adding the pilot band section 130 and the driving band lead-on section 150 to the projectile body is nearly invisible to the overall wave drag of the body itself due to the LD-Haack profiles of the pilot band and driving band lead-on sections. Notably, in some cases, the addition of these sections has added less than 1% to the overall wave drag on the projectile 100, whereas such sections may add up to 20% to the overall wave drag on conventional projectiles.

A tail transition section 170 may be formed on the body of the projectile 100 and disposed immediately forward of the tail section 180. As shown in FIGS. 1 and 2, the tail transition section 170 can have an angled or tapered surface, with respect to the horizontal axis of the projectile 100, that forms a transition from the tail section 180 to the portion of the projectile body adjacent to the tail transition section 170 on a forward side thereof. In FIGS. 1 and 2, the driving band section 160 is the portion of the projectile body adjacent to the tail transition section 170 on the forward side thereof. Thus, in this case, the tail transition section 170 forms a transition from the driving band section 160 to the boat-shape of the tail section 180. The transition may be smooth, i.e., an entirety of the tail transition section 170 extends at a single angle with respect to the horizontal axis of the projectile 100, or multi-angled, i.e., the tail transition section 170 extends at plural angles with respect to the horizontal axis of the projectile 100.

A tail section 180 and base 190 can be formed at the rear end of the projectile 100. The tail section 180 may be formed having a boat tail shape which reduces in diameter from the bearing surface (e.g., driving band section 160 or bore rider section 140) until truncation occurs at the bullet base 190, the extreme aft portion of the projectile 100 that is oriented in the aerodynamic shadow of the projectile body. The base 190 may be machined to increase handling resistance so that the projectile 100 is less prone to damage after manufacturing.

Figure 3:
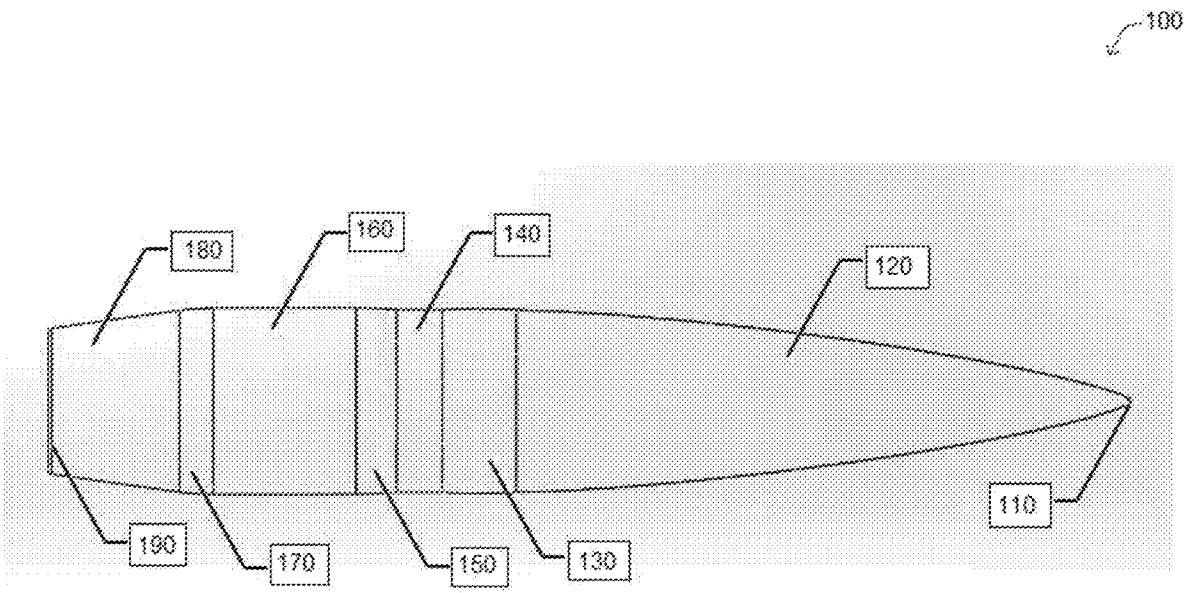
FIG. 3 illustrates a side view of an exemplary projectile having an enlarged body according to embodiments of the present disclosure.

FIG. 3 illustrates a side view of an exemplary projectile having an enlarged body according to embodiments of the present disclosure. As shown in FIG. 3, the projectile 100 may include, in order from a front of the projectile 100 to its rear, a meplat 110, an ogival nose section 120, a pilot band section 130, a bore rider section 140, a driving band lead-on section 150, a driving band section 160, a tail transition section 170, a tail section 180, and a base 190, similar to the arrangement shown in FIGS. 1 and 2. In FIG. 3, however, the projectile 100 is made bigger and longer by increasing the length to radius (L:R) ratio. Further, the bore rider section 140 is decreased in length, whereas the pilot band section 130 is increased in length. The effect is a projectile 100 having increased mass as well as increased ballistic coefficiency, while simultaneously reducing drag on the projectile body due to the LD-Haack profiles of the nose section 120, pilot band 130, and driving band lead-on section 150.

FIG. 4 illustrates a three-dimensional view of an exemplary projectile with rifling grooves according to embodiments of the present disclosure. As shown in FIG. 4, the projectile 100 has a similar arrangement of components as shown above. Here, however, helical recessed regions 420 may be formed in an outer surface of the projectile 100. The recessed regions or grooves 420 may longitudinally extend along a portion of the projectile body. More specifically, the projectile 100 may be formed so that the recessed regions 420 longitudinally extend along the driving band section 160, as well as one or more sections adjacent to the driving band section 160.

Furthermore, adjacent to the driving band section 160 on a rearward side thereof, a driving band lead-off section 410 can be formed on the body of the projectile 100. The driving band lead-off section 410 is described in further detail with respect to FIG. 5 which illustrates a three-dimensional view of an exemplary projectile designed for optimal magazine loading according to embodiments of the present disclosure. As shown in FIG. 5, the pilot band section 130 has been removed from the projectile 100. The ballistic coefficient of the projectile 100 tends to be higher due to the removal of the pilot band, as well as smoother transitions to the tail and the reduction in wave-drag producing features.

Moreover, by removing the pilot band section 130, as shown in FIG. 5, the bearing surface of the projectile 100 is shifted forward and the fineness ratio of the nose section 120 is lowered. This way, the projectile 100 can be loaded into a magazine of a standard long action rifle for military use with a 0.30 caliber cartridge, as an example. Thus, instead of using the pilot band section 130, the driving band section 160 can be shifted forward to engage the rifling as a so-called dual diameter bullet. Notably, a design meant simply to optimize aerodynamic efficiency (e.g., drag, BC, form factor, and the like) for a specific caliber and bullet weight, as shown in FIGS. 1-4, may employ a higher fineness ratio than a bullet that may compromise aerodynamic efficiency in order to meet a requirement such as magazine length in a specific cartridge case, as shown in FIG. 5.

Additionally, the projectile 100 may include a driving band lead-off section 410 disposed adjacent to a rearward side of the driving band section 160. Similar to the driving band lead-on section 150, the driving band lead-off section 410 can have an angled or tapered surface, with respect to a horizontal axis of the projectile 100, forming a transition. The transition formed by the driving band lead-off section 410 may be smooth, i.e., an entirety of the driving band lead-off section 410 extends at a single angle with respect to the horizontal axis of the projectile 100, or multi-angled, i.e., the driving band lead-off section 410 extends at plural angles with respect to the horizontal axis of the projectile 100.

The driving band lead-off section 410 forms a transition from the driving band section 160 to the portion of the projectile body adjacent to the driving band lead-off section 410 on a rearward side thereof. In FIG. 5, the bore rider section 140 is the portion of the projectile body adjacent to the driving band lead-off section 410 on the rearward side thereof. Thus, in this case, the driving band lead-off section 410 forms a transition from the driving band section 160 to the bore rider section 140. This linear expansion rate transition brings the projectile diameter down from the groove diameter (i.e., the driving band section 160) to the bore diameter (i.e., the bore rider section 140) as a means for shifting the bearing surface forward on the projectile body in order to "slide" the bullet farther down into the cartridge case and allow for magazine feeding from traditional rifle magazine boxes more effectively. It also allows for the removal of the pilot band, as explained above, as well as the forward placement of the bore rider section 140 between the pilot band section 130 and the driving band section 160 (the respective positions of the bore rider section 140 and driving band section 160 have been switched in FIG. 5, as compared to FIGS. 1-4).

Like driving band lead-on section 150, the driving band lead-off section 410 can be formed having an LD-Haack profile to reduce the effect of drag on the projectile 100. Therefore, the effect of adding the driving band lead-off section 410 to the projectile body is nearly invisible to the overall wave drag of the body itself due to the LD-Haack profiles thereof.

Accordingly, the projectile disclosed herein uses a series of LD-Haack shaped features to minimize drag exhibited on the projectile body and enhance overall ballistic efficiency. At typical flight speeds of bullets, which is commonly Mach 3.0 down to approximately Mach 0.8 (on a long-distance shot, for example), research has proven that the LD-Haack or von Kármán shape is the superior design in terms of efficiency. Furthermore, additional features, such as the pilot band section, bore rider section, and driving band section, each having distinct diameters, can be added to the projectile to improve overall flight ballistics while contributing virtually no additional drag to the projectile body during flight. The result is a projectile that exhibits higher efficiencies while moving through the rifle bore, as well as subsequent flight downrange, and greater accuracy and precision upon impact of a target, when compared with conventional bullets having a similar weight, a similar BC, or the like.

While there have been shown and described illustrative embodiments that provide for a projectile having enhanced ballistic efficiency due to LD-Haack shaped features, it is to be understood that various other adaptations and modifications may be made within the spirit and scope of the embodiments herein. Thus, the embodiments may be modified in any suitable manner in accordance with the scope of the present claims.

The foregoing description has been directed to embodiments of the present disclosure. It will be apparent, however, that other variations and modifications may be made to the described embodiments, with the attainment of some or all of their advantages. Accordingly, this description is to be taken only by way of example and not to otherwise limit the scope of the embodiments herein. Therefore, it is the object of the appended claims to cover all such variations and modifications as come within the true spirit and scope of the embodiments herein.

What is claimed is:

1. A projectile for use with a firearm having a rifled barrel including helical grooves extending longitudinally along an inner surface thereof, the projectile comprising:

a substantially cylindrical projectile body having at a front end an ogive and at a rear end a tail section;

a driving band section formed on the projectile body between the ogive and the tail section having a first diameter;

a bore rider section formed on the projectile body between the ogive and the tail section having a second diameter different from the first diameter; and a pilot band section formed on the projectile body forward of the driving band section having a third diameter different from the first diameter and the second diameter, wherein the bore rider section is in contact with the pilot band section.

2. The projectile of claim 1, wherein the first diameter is approximately equal to a groove diameter of the barrel.

3. The projectile of claim 1, wherein the second diameter is approximately equal to a bore diameter of the barrel.

4. The projectile of claim 1, wherein the third diameter is between a groove diameter of the barrel and a bore diameter of the barrel.

5. The projectile of claim 1, wherein the first diameter is approximately equal to a groove diameter of the barrel, the second diameter is approximately equal to a bore diameter of the barrel, and the third diameter is between the first diameter and the second diameter.

6. The projectile of claim 1, wherein the bore rider section is disposed between the pilot band section and the driving band section.

7. The projectile of claim 1, wherein the bore rider section is formed to contact an inner surface of a bore of the barrel, and the driving band section is formed to engage the grooves of the barrel.

8. The projectile of claim 1, further comprising:

helical recessed regions formed in an outer surface of the projectile body and longitudinally extending along a portion of the projectile body.

9. The projectile of claim 8, wherein the recessed regions longitudinally extend along the driving band section.

10. The projectile of claim 1, further comprising:

a tail transition section formed on the projectile body adjacent to the tail section on a forward side thereof and having an angled surface, with respect to a horizontal axis of the projectile body, that forms a transition from the tail section to a portion of the projectile body adjacent to the tail transition section on a forward side thereof.

11. The projectile of claim 1, wherein a tip of the ogive is spherically blunted.

12. The projectile of claim 1, wherein the ogive is formed having an LD-Haack shape.

13. The projectile of claim 1, wherein the projectile body is a monolithically formed body.

14. The projectile of claim 1, wherein the tail section is formed having a boat tail shape.

15. The projectile of claim 1, wherein the projectile body is made of at least one solid material selected from a group consisting of: copper, a copper alloy, aluminum, tungsten, a polymeric material, and a synthetic material.

16. The projectile of claim 15, wherein the copper alloy is C14-700.

17. The projectile of claim 16, wherein the copper alloy has a work hardness of at least half hard.

18. A projectile for use with a firearm having a rifled barrel including helical grooves extending longitudinally along an inner surface thereof, the projectile comprising:

a substantially cylindrical projectile body having at a front end an ogive and at a rear end a tail section;

a driving band section formed on the projectile body between the ogive and the tail section having a first diameter;

a bore rider section formed on the projectile body between the ogive and the tail section having a second diameter different from the first diameter; and a pilot band section formed on the projectile body forward of the driving band section having a third diameter different from the first diameter and the second diameter, wherein the pilot band section is disposed aft of a distalmost end of the ogive.

19. The projectile of claim 18, wherein the pilot band section is geometrically distinct from the ogive.

* * * * *